US011109632B2

(12) United States Patent
Suddaby

(10) Patent No.: US 11,109,632 B2
(45) Date of Patent: Sep. 7, 2021

(54) PROTECTIVE HELMET

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 337 days.

(21) Appl. No.: 16/194,471

(22) Filed: Nov. 19, 2018

(65) Prior Publication Data

US 2019/0082766 A1 Mar. 21, 2019

Related U.S. Application Data

(63) Continuation of application No. 15/257,437, filed on Sep. 6, 2016, now Pat. No. 10,165,818, which is a continuation of application No. 13/412,782, filed on Mar. 6, 2012, now abandoned.

(51) Int. Cl.

| | |
|---|---|
| ***A42B 3/06*** | (2006.01) |
| ***A42B 3/12*** | (2006.01) |
| ***A42B 3/14*** | (2006.01) |
| ***A42B 3/20*** | (2006.01) |
| ***A42B 3/22*** | (2006.01) |

(52) U.S. Cl.

CPC ..... *A42B 3/064* (2013.01); *A42B 3/121* (2013.01); *A42B 3/122* (2013.01); *A42B 3/125* (2013.01); *A42B 3/14* (2013.01); *A42B 3/20* (2013.01); *A42B 3/221* (2013.01)

(58) Field of Classification Search

CPC ..... A42B 3/0486; A42B 3/121; A42B 3/14; A42B 3/06; A42B 3/064; A42B 3/122; A42B 3/125; A42B 3/20; A42B 3/221

See application file for complete search history.

(56) References Cited

U.S. PATENT DOCUMENTS

| | | | | |
|---|---|---|---|---|
| 3,616,463 | A | 11/1971 | Theodore et al. | |
| 3,668,704 | A | 6/1972 | Conroy et al. | |
| 3,872,511 | A | 3/1975 | Nichols | |
| 3,875,275 | A | 4/1975 | Lemelson | |
| 3,946,441 | A | 3/1976 | Johnson | |
| 4,023,209 | A | 5/1977 | Frieder, Jr. et al. | |
| 4,075,717 | A | 2/1978 | Lemelson | |
| 4,307,471 | A | 12/1981 | Lovell | |
| 4,586,200 | A | 5/1986 | Poon | |
| 5,014,366 | A * | 5/1991 | Discipio, Sr. ..... | A42B 3/061 2/410 |
| 5,181,279 | A | 1/1993 | Ross | |
| 5,204,998 | A | 4/1993 | Liu | |

(Continued)

FOREIGN PATENT DOCUMENTS

| | | |
|---|---|---|
| CN | 201094314 | 8/2008 |
| DE | 19544375 | 3/1997 |

(Continued)

*Primary Examiner* — Sally Haden

(74) *Attorney, Agent, or Firm* — Simpson & Simpson, PLLC; Michael Nicholas Vranjes

(57) ABSTRACT

A protective helmet, including an outer shell including at least one aperture, an inner shell slidingly connected to the outer shell, and at least one expandable bladder positioned between the outer shell and the inner shell, wherein, when a force strikes the helmet, the at least one expandable bladder is operatively arranged to displace radially outward in the at least one aperture and protrude beyond an outer surface of the outer shell.

19 Claims, 8 Drawing Sheets

(56) References Cited

U.S. PATENT DOCUMENTS

| | | | | |
|---|---|---|---|---|
| 5,263,202 | A | 11/1993 | Siberell | |
| 5,815,846 | A | 10/1998 | Calonge | |
| 5,950,244 | A | 9/1999 | Fournier et al. | |
| 5,956,777 | A | 9/1999 | Popovich | |
| 6,604,246 | B1 | 8/2003 | Obreja | |
| 6,658,671 | B1 | 12/2003 | Von Holst et al. | |
| 6,817,039 | B1 | 11/2004 | Grilliot et al. | |
| 7,774,866 | B2 | 8/2010 | Ferrara | |
| 7,895,681 | B2 | 3/2011 | Ferrara | |
| 8,117,676 | B1 | 5/2012 | Cardoso | |
| 2001/0032351 | A1 | 10/2001 | Nakayama et al. | |
| 2003/0217483 | A1 | 11/2003 | Abraham | |
| 2008/0229488 | A1 | 9/2008 | Kim | |
| 2011/0072548 | A1 | 3/2011 | Hersick et al. | |
| 2012/0198604 | A1 | 8/2012 | Weber et al. | |
| 2012/0233745 | A1 | 9/2012 | Veazie | |
| 2014/0173810 | A1 | 6/2014 | Suddaby | |
| 2018/0343952 | A1* | 12/2018 | Lachance ..... | A42B 3/122 |

FOREIGN PATENT DOCUMENTS

| | | |
|---|---|---|
| EP | 0048442 | 3/1982 |
| EP | 1142495 | 7/2005 |
| JP | 2001295129 | 10/2001 |
| WO | 2010/151631 | 12/2010 |

* cited by examiner

PROTECTIVE HELMET

CROSS-REFERENCE TO RELATED APPLICATIONS

This application is filed under 35 U.S.C. § 120 as a continuation of U.S. patent application Ser. No. 15/257,437, filed on Sep. 6, 2016, which application is a continuation of U.S. patent application Ser. No. 13/412,782, filed Mar. 6, 2012, which applications are hereby incorporated by reference in their entireties.

FIELD

The present disclosure relates generally to a protective helmet, and, more particularly, to a protective helmet that directs linear and rotational forces away from the braincase, the protective helmet including an expandable bladder.

BACKGROUND

The human brain is an exceedingly delicate structure protected by a series of envelopes to shield it from injury. The innermost layer, the pia mater, covers the surface of the brain. The arachnoid layer, adjacent to the pia mater, is a spidery web-like membrane that acts like a waterproof membrane. Finally, the dura mater, a tough leather-like layer, covers the arachnoid layer and adheres to the bones of the skull.

While this structure protects against penetrating trauma, the softer inner layers absorb only a small amount of energy before linear forces applied to the head are transmitted to the brain. When an object strikes a human head, both the object and the human head are moving independently and in different angles thus, angular forces, as well as linear forces, are almost always involved in head injuries. While the skull may dampen some linear forces applied to the head, it does not mitigate the effects of angular forces that impart rotational spin to the head. Many surgeons in the field believe the angular or rotational forces applied to the brain are more hazardous than direct linear forces due to the twisting or shear forces they apply to the white matter tracts and the brain stem.

One type of brain injury that occurs frequently is the mild traumatic brain injury (MTBI), more commonly known as a concussion. Such injury occurs in many settings, such as, construction worksites, manufacturing sites, and athletic endeavors and is particularly problematic in contact sports. While at one time a concussion was viewed as a trivial and reversible brain injury, it has become apparent that repetitive concussions, even without loss of consciousness, are serious deleterious events that contribute to debilitating irreversible diseases, such as, dementia and neuro-degenerative diseases including Parkinson's disease, chronic traumatic encephalopathy (CTE), and pugilistic dementias.

U.S. Pat. No. 5,815,846 (Calonge) describes a helmet with fluid filled chambers that dissipate force by squeezing fluid into adjacent equalization pockets when external force is applied. In such a scenario, energy is dissipated only through viscous friction as fluid is restrictively transferred from one pocket to another. Energy dissipation in this scenario is inversely proportional to the size of the hole between the full pocket and the empty pocket. That is to say, the smaller the hole, the greater the energy drop. Unfortunately, as the size of the hole decreases and energy dissipation increases, the time to dissipate the energy also increases. Because fluid filled chambers react hydraulically, energy transfer is in essence instantaneous. Hence, in the Cologne design, substantial energy is transferred to the brain before viscous fluid can be displaced negating a large portion of the protective function provided by the fluid filled chambers. Viscous friction is too slow an energy dissipating modification to adequately mitigate concussive force. If one were to displace water from a squeeze bottle one can get an idea as to the function of time and force required to displace any fluid when the size of the exit hole is varied. The smaller the transit hole, the greater the force required and the longer the time required for any given force to displace fluid.

U.S. Pat. No. 3,872,511 (Nichols) describes an impact absorbing covering for a helmet including hard inner and outer shells and an intermediate zone between the two shells. The intermediate zone contains fluid-filled bladders that are mounted to the inner surface of the outer shell by means of a valve. When an impact occurs, the outer shell is forced into the intermediate zone squeezing the bladders. The valve closes upon impact causing air to be retained in the bladders to cushion the impact from the user's head. However, since the bladders are restricted at impact, although the force of an impact is reduced, the force is still directed into the head. In addition, the '511 patent makes no provision for mitigating rotational forces striking the helmet.

U.S. Pat. No. 6,658,671 (Hoist) describes a helmet with inner and outer shells and a sliding layer. The sliding layer allows for the displacement of the outer shell relative to the inner shell to help dissipate some of the angular force during a collision applied to the helmet. However, the force dissipation is confined to the outer shell of the helmet. In addition, the Holst helmet provides no mechanism for returning the two shells to the resting position relative to each other. A similar shortcoming is seen in the helmet described in U.S. Pat. No. 5,956,777 (Popovich) and European patent publication EP 0048442 (Kalman et al.).

German Patent DE 19544375 (Zhan) describes a construction helmet that includes apertures in the hard outer shell that allows the expansion of cushion material through the apertures to dispel some of the force of a collision. However, because the inner liner rests against a user's head, some force is directed toward rather than away from the head.

U. S. Patent Application Publication No. 2012/0198604 (Weber et al.) describes a safety helmet for protecting the human head against repetitive impacts as well as moderate and severe impacts to reduce the likelihood of brain injury caused by both translational and rotational forces. The helmet includes isolation dampers that act to separate an outer liner from an inner liner. Gaps are provided between the ends of the outer liner and the inner liner to provide space to enable the outer liner to move without contacting the inner liner upon impact.

Clearly to prevent traumatic brain injury, not only must penetrating objects be stopped, but any force, angular or linear, imparted to the exterior of the helmet must also be prevented from simply being transmitted to the enclosed skull and brain. The helmet must not merely play a passive role in dampening such external forces, but must play an active role in dissipating both linear and angular momentum imparted such that they have little or no deleterious effect on the delicate brain.

To afford maximal protection from linear and angular forces, the skull and the brain must be capable of movement independent of each other, and to have mechanisms which dissipate imparted kinetic energy, regardless of the vector or vectors by which it is applied.

To attain these objectives in a helmet design, the inner component (shell) and the outer component (shell or shells) must be capable of appreciable degrees of movement independent of each other. Additionally, the momentum imparted to the outer shell should both be directed away from and/or around the underlying inner shell and brain and sufficiently dissipated so as to negate deleterious effects.

There is a long-felt need to provide a protective helmet that mitigates the deleterious consequences of repetitive traumatic brain injury.

SUMMARY

According to aspects illustrated herein, there is provided a protective helmet, comprising an outer shell including at least one aperture, an inner shell slidingly connected to the outer shell, and at least one expandable bladder positioned between the outer shell and the inner shell, wherein, when a force strikes the helmet, the at least one expandable bladder is operatively arranged to displace radially outward in the at least one aperture and protrude beyond an outer surface of the outer shell.

According to aspects illustrated herein, there is provided a protective helmet, comprising an outer shell including at least one aperture, an inner shell slidingly connected to the outer shell, wherein the inner shell is spaced apart from the outer shell, and at least one expandable bladder positioned between the outer shell and the inner shell, the at least one expandable bladder arranged in sliding contact with an outer surface of the inner shell, wherein, when a force strikes the helmet, the at least one expandable bladder is operatively arranged to displace radially outward in the at least one aperture and protrude beyond an outer surface of the outer shell.

According to aspects illustrated herein, there is provided a protective helmet, comprising an outer shell including at least one aperture, an elastomeric diaphragm connected to an inner surface of the outer shell and covering the at least one aperture, an inner shell slidingly connected to the outer shell, and at least one expandable bladder positioned between the outer shell and the inner shell, the at least one expandable bladder in sliding contact with an outer surface of the inner shell and operatively arranged to displace the elastomeric diaphragm in the at least one aperture of the outer shell.

According to aspects illustrated herein, there is a provided a protective helmet including an outer shell including at least one aperture, an elastomeric diaphragm connected to an inner surface of the outer shell and covering the at least one aperture, an inner shell slidingly connected to the outer shell where the inner shell is spaced apart from the outer shell, and at least one expandable bladder positioned between the outer shell and the inner shell and operatively arranged to displace the elastomeric diaphragm in the at least one aperture of the outer shell.

In an example embodiment, the present disclosure includes a hard outer shell including apertures, a hard inner shell, a padded inner liner functionally attached to the hard inner shell, an intermediate shell contacting the padded inner liner and enclosing cushioning pieces, fluid-filled bladders positioned between the outer shell and the padded inner liner, and, elastomeric cords connecting the outer shell and the inner liner and passing through the intermediate shell.

One object of the disclosure is to provide a helmet that directs linear and rotational forces away from the braincase.

A second object of the disclosure is to supply a helmet that includes an outer shell that floats or is suspended above the inner shell.

A third object of the disclosure is to offer a helmet with a sliding connection between the inner and outer shells.

An additional object of the disclosure is to supply a helmet that includes a crumple zone to absorb forces before they reach the braincase of the user.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
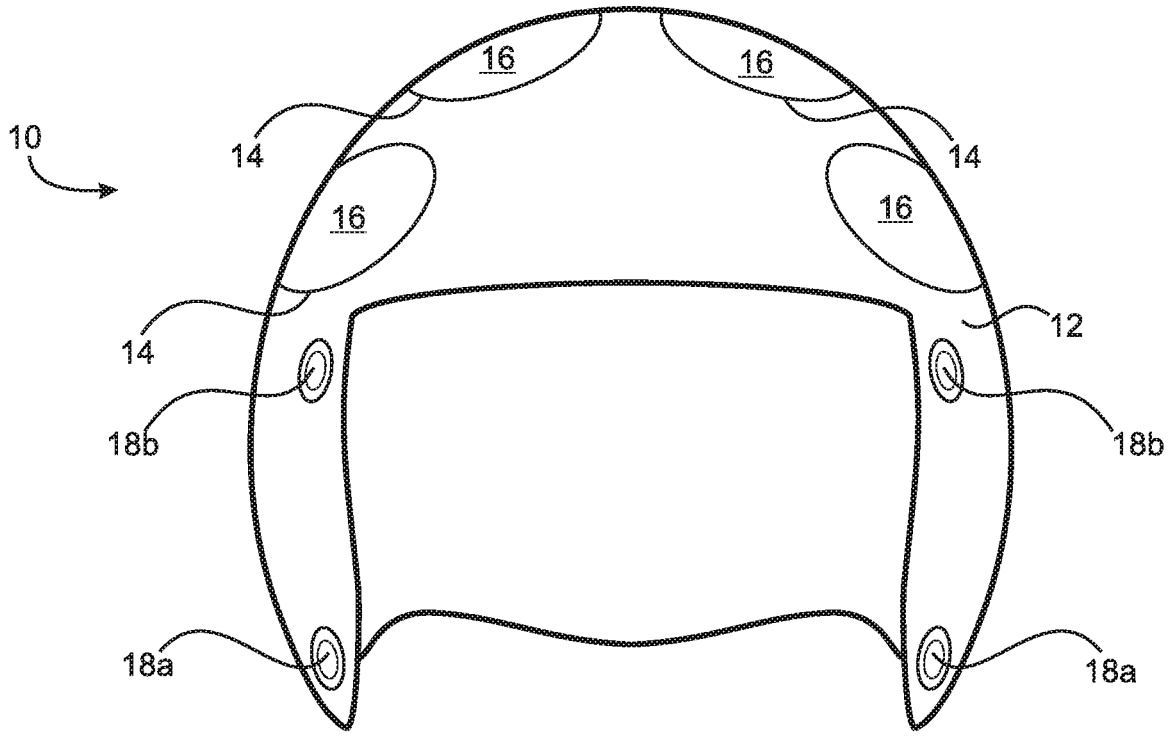
FIG. 1 is a front view of a double shell helmet ("helmet")

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

In the present disclosure, a helmet is presented that includes multiple protective zones formed in layers over the user's skull or braincase. The outer protective zone is formed by an outer shell that "floats" or is suspended on the inner shell such that rotational force applied to the outer shell cause it to rotate, or translate around the inner shell rather than immediately transfer such rotational or translational force to the skull and brain.

The inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like mini bungee cords that dissipate both angular and linear forces through a mechanism known as hysteretic damping, i.e., when elastomeric cords are deformed, internal friction causes high energy losses to occur. These elastomeric cords are of particular value in preventing so called contrecoup brain injury.

The outer shell, in turn, floats on the inner shell by virtue of one or more fluid filled bladders located between the inner shell and the outer shell. To maximize the instantaneous reduction or dissipation of a linear and/or angular force applied to the outer shell, the fluid filled bladders interposed between the hard inner and outer shells may be intimately associated with, that is, located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms are located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid filled helmets fail. The transfer of force is hydraulic and essentially instantaneous, negating the effectiveness of viscous fluid transfers as a means of dissipating concussive force.

Because of the elastomeric diaphragms in the present disclosure, any force imparted to the outer shell will transfer to the gas or liquid in the bladders, which, in turn, instantaneously transfers the force to the external elastomeric diaphragms covering the apertures in the outer shell. The elastomeric diaphragms, in turn, bulge out through apertures in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low level heat, which, in turn, is dissipated harmlessly to the surrounding air.

Furthermore, the elastomeric springs or cords that bridge the space holding the fluid filled bladders (like the arachnoid membrane in the brain) serve to stabilize the spatial relationship of the inner and outer shells and provide additional dissipation of concussive force via the same principle of elastic deformation via the mechanism of stretching, torsion, and even compression of the elastic cords.

By combining the bridging effects of the elastic springs or cords as well as the elastomeric diaphragms strategically placed at external apertures, both linear and rotational forces can be effectively dissipated.

Henceforth, my design, by employing elastomeric cords and diaphragms can protect against concussion as well as so-called coup and contrecoup brain injury and torsional brain injury which can cause subdural hematoma by tearing of bridging veins or injury to the brain stem through twisting of the stem about its central axis.

Adverting to the drawings, FIG. 1 is a front view of helmet 10 ("helmet 10") including outer shell 12 and inner shell 20. Outer shell 12 and is preferably manufactured from rigid, impact resistant materials such as metals, plastics, such as, polycarbonates, ceramics, composites and similar materials well known to those having ordinary skill in the art. Outer shell 12 defines at least one and preferably a plurality of apertures 14. Apertures 14 may be open but, are preferably covered by a flexible elastomeric material in the form of diaphragm 16. In a preferred embodiment, helmet 10 also includes several face protection device attachments 18*a*, 18*b*. In a more preferred embodiment, face protection device attachments 18*a*, 18*b* are fabricated from a flexible elastomeric material to provide flexibility to the attachment. The elastomeric material reduces the rotational pull on helmet 10 if the attached face protection device (not shown in FIG. 1) is pulled. The term "elastomeric" means made of any substance resembling rubber in properties, such as resilience and flexibility. Such elastomeric materials are well known to those having ordinary skill in the art.

Figure 2:
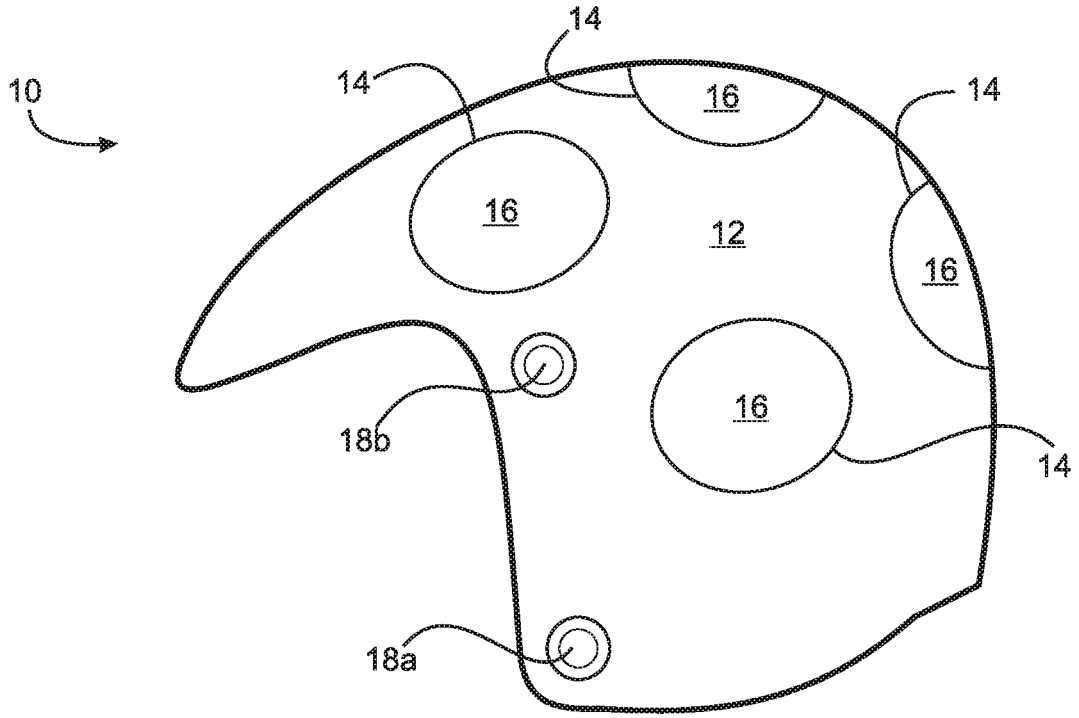
FIG. 2 is a side view of the helmet of FIG. 1 including two face protection device attachments on one side of the helmet.

FIG. 2 is a side view of helmet 10 showing two face protection device attachments 18*a* and 18*b* on one side of the helmet. Examples of face protection devices are visors and face masks. Such attachments can also be used for chin straps releasably attached to the helmet in a known manner.

Figure 3A:
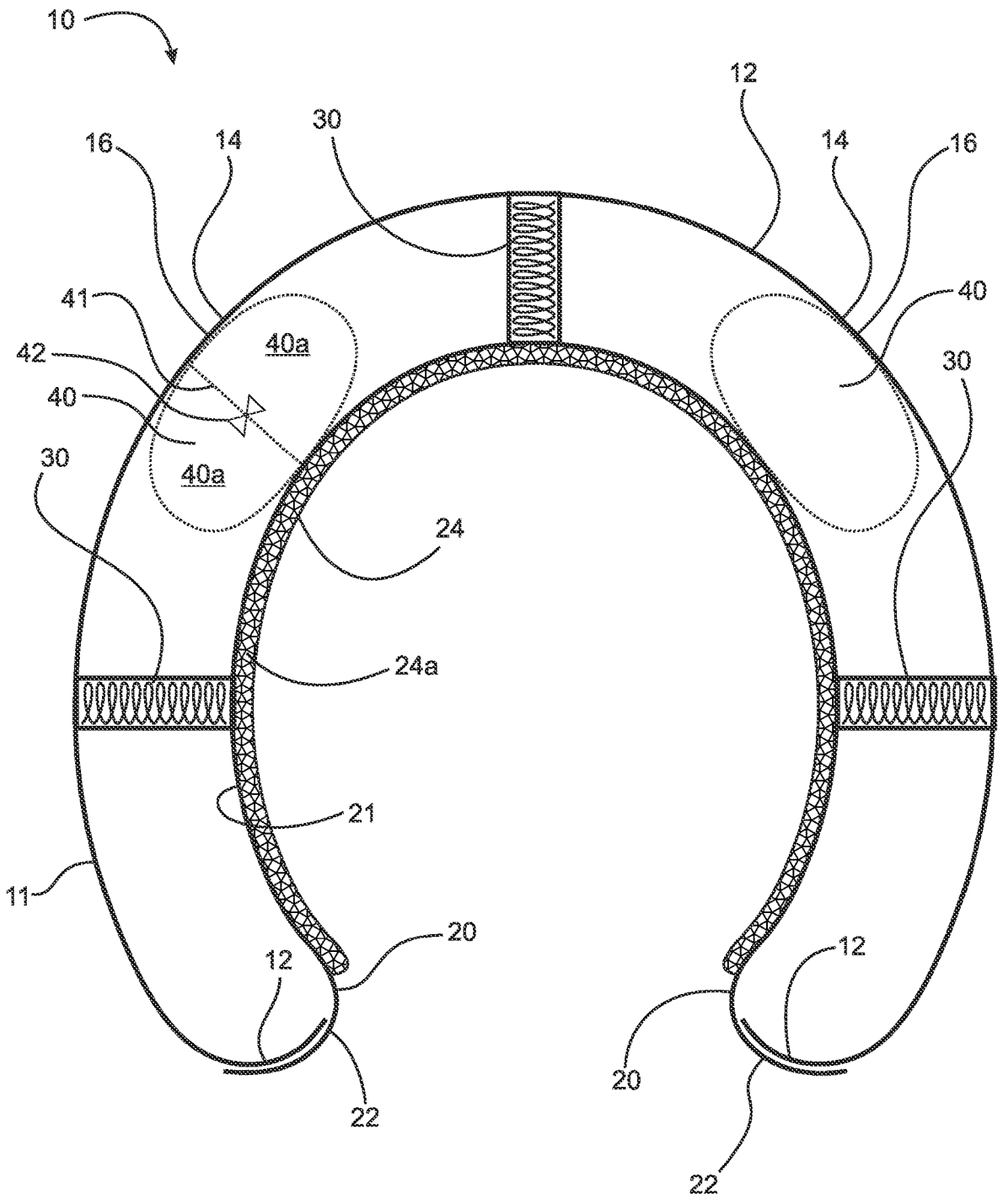
FIG. 3A is a cross-sectional view of the helmet of FIG. 1 showing the inner shell and the elastomeric cords connecting the two shells.

FIG. 3A is a cross-sectional view of helmet 10 showing hard outer shell 12, hard inner shell 20, and elastomeric springs or cords 30 ("cords 30") that extend through an elastomeric zone connecting the two shells. Inner shell 20 forms an anchor zone and is preferably manufactured from rigid, impact resistant materials such as metals, plastics, such as, polycarbonates, ceramics, composites and similar materials well known to those having ordinary skill in the art. Inner shell 20 and outer shell 12 are slidingly connected at sliding connection 22. The term "slidingly connected" means that the edges of inner shell 20 and outer shell 12, respectively, slide against or over each other at connection 22. In an alternate embodiment, outer shell 12 and inner shell 20 are connected by an elastomeric element, for example, a u-shaped elastomeric connector 22*a* ("connector 22*a*"). Sliding connection 22 and connector 22*a* each serve to both dissipate energy and maintain the spatial relationship between outer shell 12 and inner shell 20.

Cords 30 are flexible cords, such as, bungee cords or elastic "hold down" cords or their equivalents used to hold articles on car or bike carriers. This flexibility allows outer shell 12 to move or "float" relative to inner shell 20 and still remain connected to inner shell 20. This floating capability is also enabled by the sliding connection 22 between outer shell 12 and inner shell 20. In an alternate embodiment, sliding connection 22 may also include elastomeric connection 22*a* between outer shell 12 and inner shell 20. Padding 24 forms an inner zone and lines the inner surface of inner shell 20 to provide a comfortable material to support helmet 10 on the user's head. In one embodiment, padding 24 may enclose loose cushioning pieces, such as, STYROFOAM® brand beads 24*a* or "peanuts" or loose oatmeal.

FIG. 3A is also a cross-sectional view of bladders 40 situated in the elastomeric zone between outer shell 12 and inner shell 20. Helmet 10 includes at least one and preferably a plurality of bladders 40. As shown in the figure, bladders 40 abut against outer surface 21 of inner shell 20 (i.e., bladders 40 are in frictional contact with outer surface 21 of inner shell 20). Bladders 40 are capable of sliding over outer surface 21 of inner shell 20, which allows for greater lateral or rotational displacement of the inner shell 20 and the outer shell 12. Bladders 40 are filled with fluid, either a liquid such as water or a gas such as helium or air. In one preferred embodiment, the fluid is helium as it is light and its use would reduce the total weight of helmet 10. In an alternate embodiment, bladders 40 may also include compressible beads or pieces such as STYROFOAM® brand beads. Bladders 40 are preferably located under apertures 14 of outer shell 12 and are in contact with both inner shell 20 and outer shell 12. Thus, if outer shell 12 is pressed in toward inner shell 20 and the user's skull during a collision, the fluid in one or more of bladders 40 compresses and squeezes bladder 40, similar to squeezing a balloon. Bladder 40 bulges toward aperture 14 and displaces elastomeric diaphragm 16. This bulging-displacement action diverts the force of the blow from the user's skull and brain up toward the aperture providing a new direction for the force vector. Bladders 40 may also be divided internally into compartments 40*a* by bladder wall 41 such that if the integrity of one compartment is breached, the other compartment still functions to dissipate linear and rotational forces. Valve(s) 42 may also be included between the compartments to control the fluid movement.

Figure 3B:
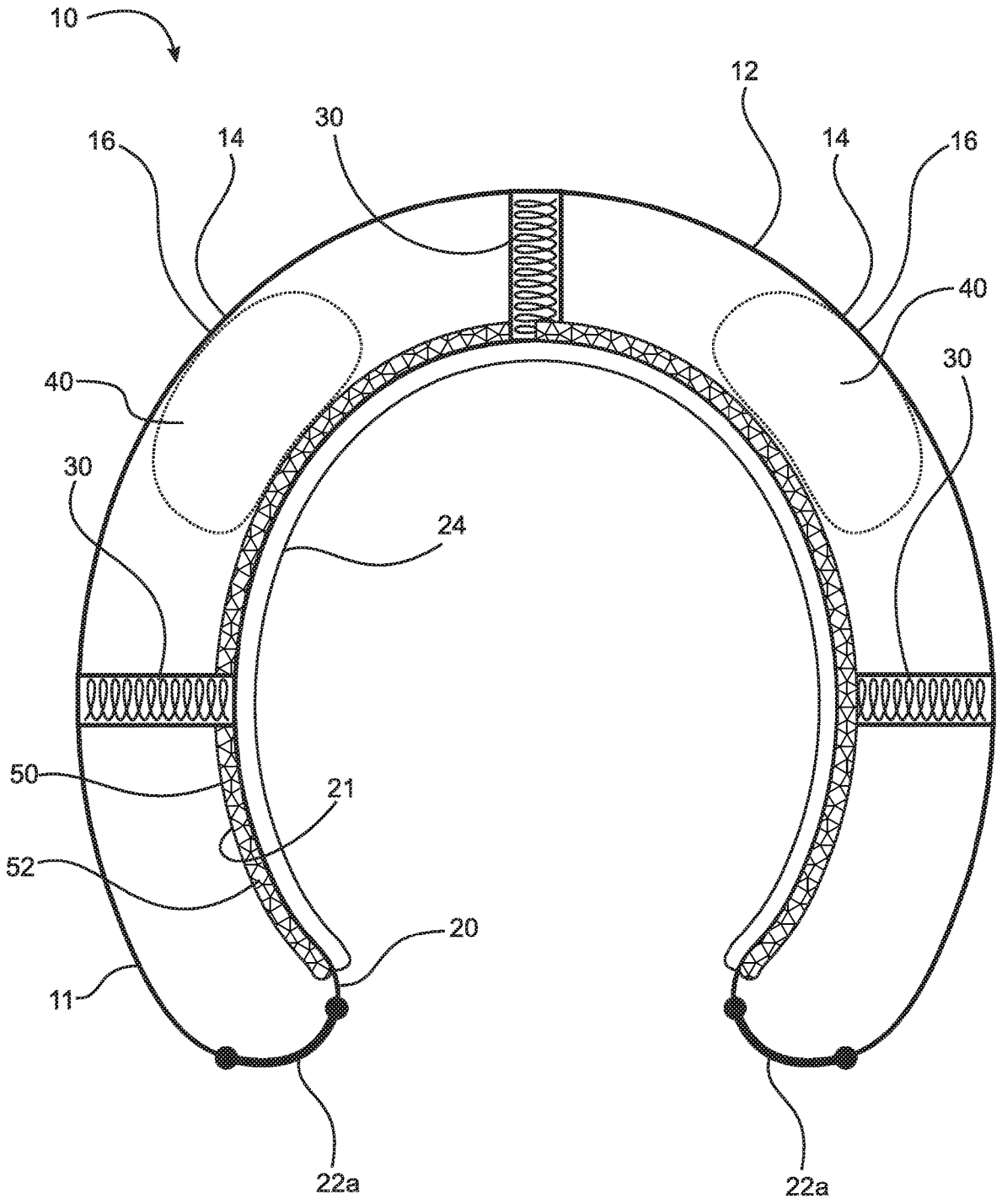
FIG. 3B is a cross-sectional view of the helmet of FIG. 1 including an intermediate shell enclosing cushioning pieces.

FIG. 3B is a cross-sectional view similar to FIG. 3A discussed above depicting an alternate embodiment of helmet 10. Helmet 10 in FIG. 3B includes a crumple zone formed by intermediate shell 50 located between outer shell 12 and inner shell 20. In the embodiment shown, intermediate shell 50 is close to or adjacent to inner shell 20. As seen in FIG. 3B, intermediate shell 50 encloses filler 52. Preferably, filler 52 is a compressible material that is packed to deflect the energy of a blow to protect the skull, similar to a "crumple zone" in a car. The filler is designed to crumple or deform, thereby absorbing the force of the collision before it reaches padding 24 and the brain case. In this embodiment, cords 30 extend from inner shell 20 to outer shell 12 through intermediate shell 50. In the embodiment shown in FIGS. 3A and 3B, cords 30 comprise helical springs. One suitable filler 52 is STYROFOAM® brand beads or "peanuts" or equivalent material, such as, any suitable material that is used in packing objects. Because of its "crumpling" function, intermediate shell 50 is preferably constructed with softer or more deformable materials than outer shell 12 or inner shell 20. Typical fabrication material for intermediate shell 50 is a stretchable material such as latex or spandex or other similar elastomeric fabric that preferably encloses filler 52.

Figure 4A:
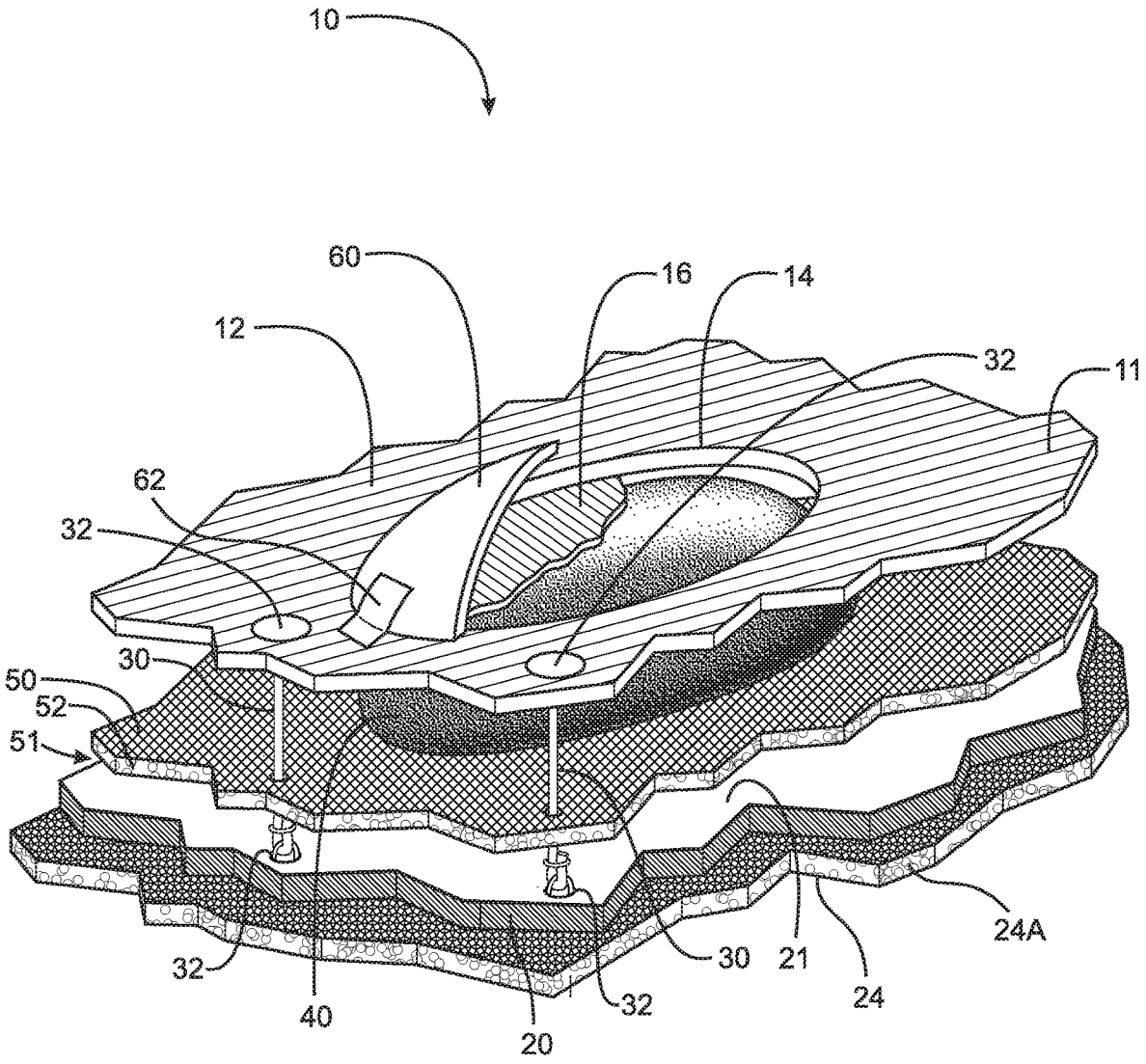
FIG. 4A is a fragmentary exploded view of the helmet of FIG. 1 including part of a liftable lid that protects a diaphragm covering an aperture.

FIG. 4A is a fragmentary exploded view of one section of outer shell 12 of helmet 10 including liftable lids 60 ("lid 60") used to cover aperture 14 to shield diaphragm 16 and/or bladder 40 from punctures, rips, or similar incidents that may destroy their integrity.

Figure 4B:
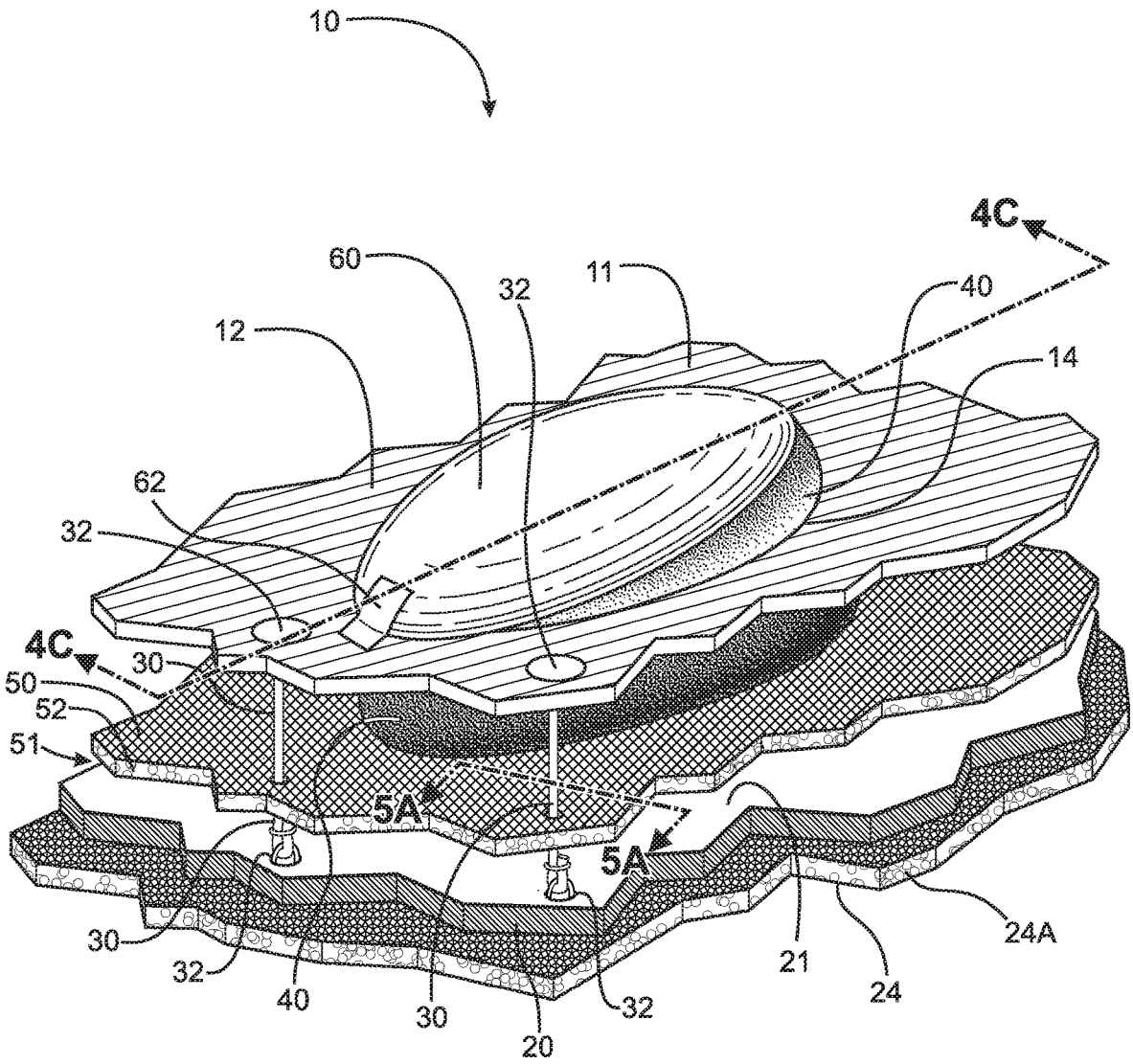
FIG. 4B is a fragmentary exploded view of the helmet of FIG. 1 depicting a liftable lid protecting a bulging fluid-filled bladder.
Figure 4C:
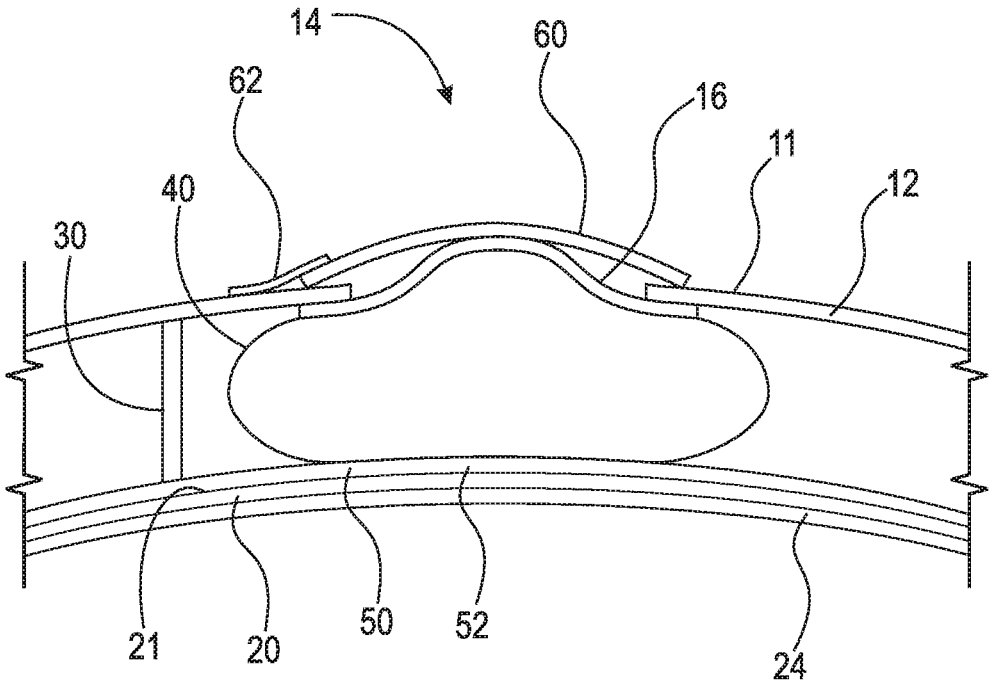
FIG. 4C is a cross-sectional view taken generally along line 4C-4C in FIG. 4B.

FIG. 4B is a fragmentary exploded view of one section of outer shell 12 of helmet 10 including lid 60 covering aperture 14 and bladder 40. FIG. 4C is a cross-sectional view of helmet 10 taken generally along line 4C-4C. Lids 60 are attached to outer shell 12 by lid connector 62 ("connector 62") in such a way that they lift or raise up if a particular diaphragm 16 bulges outside of aperture 14 due to the expansion of one or more bladders 40, exposing it to additional collisions. Because it is liftable, lid 60 allows diaphragm 16 to freely elastically bulge through aperture 14 above surface 11 of outer shell 12 to absorb the force of a collision, but still be protected from damage caused by external forces. In an alternate embodiment, diaphragm 16 is not used and lid 60 directly shields and protects bladder 40. In one embodiment, lids 60 are attached to outer shell 12 using hinges. In an alternate embodiment, lids 60 are attached using flexible plastic. Elastomeric cords 30, crumple zone 51, and intermediate shell 50 are also shown.

Figure 5:
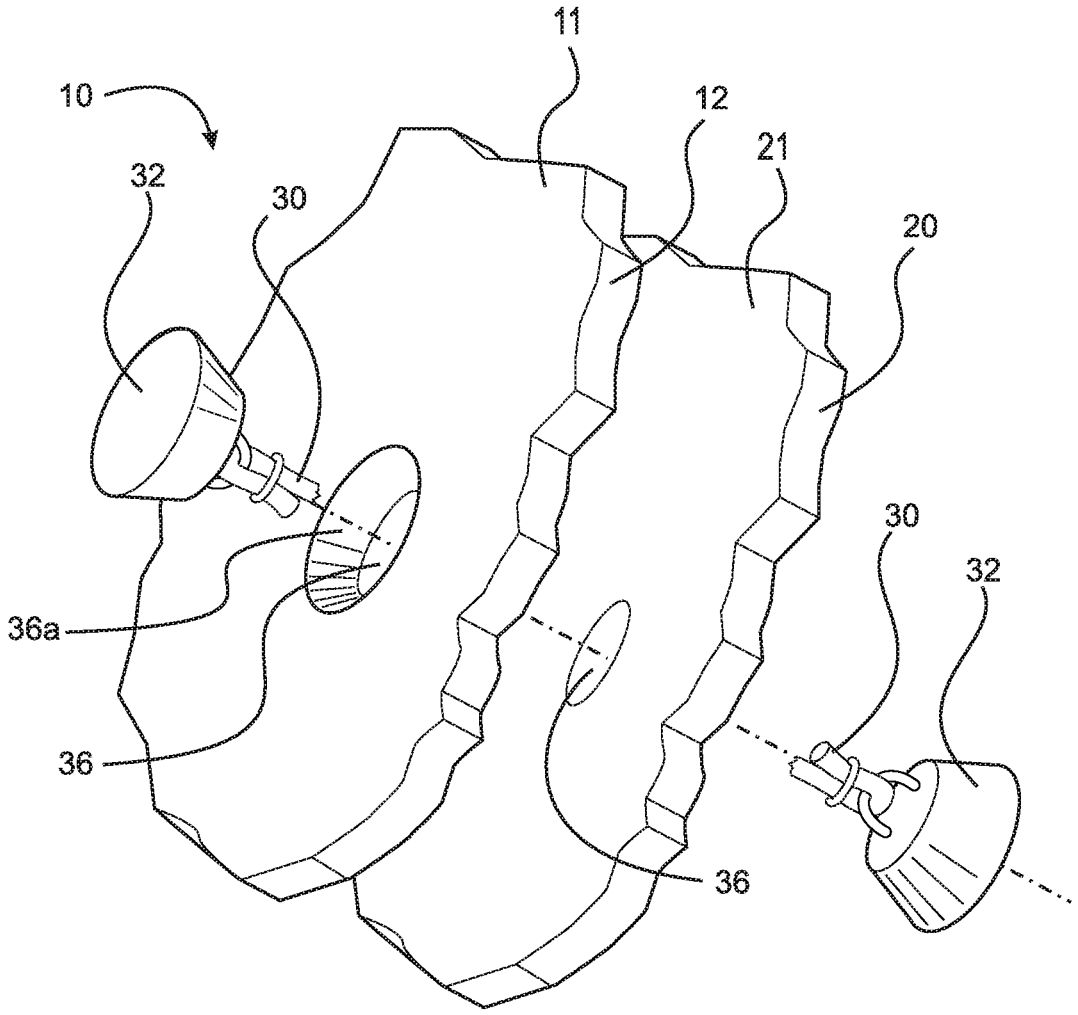
FIG. 5 is a fragmentary exploded view of a cord connecting the inner shell and outer shells of the helmet of FIG. 1; and, FIG. 5A is a cross-sectional view of a cord and plugs between the inner and outer shells of the helmet taken generally along line 5A-5A in FIG. 4B.

FIG. 5 is a fragmentary exploded view of cord 30 connecting inner and outer shells 12, 20 of helmet 10. Cord 30 is attached to helmet 10 to enable outer shell 12 to float over inner shell 20. Cavities 36, preferably with concave sides 36*a*, are drilled or otherwise placed in outer shell 12 and inner shell 20 so that the holes are aligned. Each end of cord 30 is attached to plugs 32 which are then placed in the aligned holes. In one embodiment, plugs 32 are held in cavities 36 using suitable adhesives known to those having ordinary skill in the art. In an alternate embodiment, plugs 32 are held in cavities 36 with a friction fit or a snap fit.

Figure 5A:
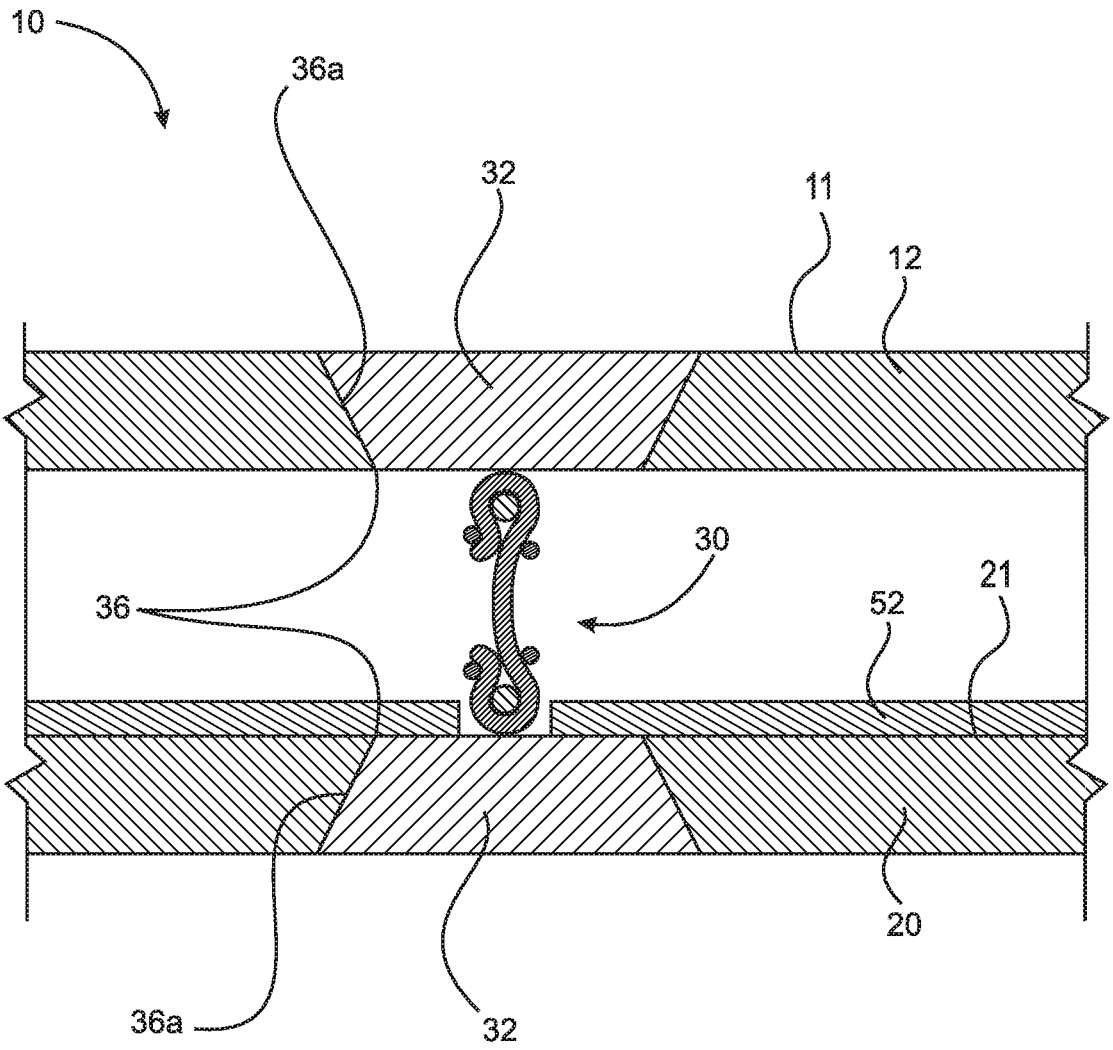

FIG. 5A is a cross-sectional view of cord 30 and plugs 32 between inner and outer shells 12, 20 of helmet 10 taken generally along line 5A-5A in FIG. 4B. Cord 30 is attached to two plugs 32, 32 and extends between outer shell 12 and inner shell 20. Filler 52 of intermediate shell 50 is shown proximate inner shell 20. Bladders 40 are not shown. In an embodiment including bladders 40, the bladders would be disposed between intermediate shell 50 (or inner shell 20) and outer shell 12.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Helmet
11 Surface
12 Outer shell
14 Aperture
16 Diaphragm
18 Attachment
20 Inner shell
21 Surface
22 Sliding connection
24 Padding
22*a* Connector
30 Cord
32 Plug

36 Cavity
36*a* Concave sides
40 Bladder
40*a* Compartments
41 Bladder wall
42 Valve
50 Intermediate shell
52 Filler
60 Lid
62 Lid connector

What is claimed is:

1. A protective helmet, comprising:

an outer shell including at least one aperture;

an inner shell slidingly connected to the outer shell, wherein the outer shell is connected to the inner shell by at least one elastomeric cord; and, at least one expandable bladder positioned between the outer shell and the inner shell;

wherein, when a force strikes the helmet, the at least one expandable bladder is operatively arranged to displace radially outward in the at least one aperture and protrude beyond an outer surface of the outer shell.

2. The protective helmet recited in claim 1, further comprising an intermediate shell positioned between the outer shell and the inner shell and the at least one expandable bladder is positioned between the intermediate shell and the outer shell.

3. The protective helmet as recited in claim 2, wherein said intermediate shell encloses filler.

4. The protective helmet recited in claim 1, further comprising padding arranged to line an inner surface of the inner shell.

5. The protective helmet recited in claim 1, wherein the at least one expandable bladder includes compressible beads.

6. The protective helmet recited in claim 1, wherein the at least one expandable bladder is in contact with both the outer shell and the inner shell.

7. The protective helmet recited in claim 6, wherein the at least one expandable bladder is arranged to bulge through the at least one aperture of the outer shell when the outer shell is displaced radially toward the inner shell.

8. The protective helmet recited in claim 1, further comprising a lid arranged to cover the at least one aperture and the at least one expandable bladder.

9. The protective helmet recited in claim 8, wherein the lid is hingedly connected to the outer surface of the outer shell.

10. The protective helmet recited in claim 1, wherein the at least one elastomeric cord comprises:

a first end secured within an outer shell cavity by a first plug; and, a second end secured within an inner shell cavity by a second plug.

11. The protective helmet as recited in claim 1, wherein said at least one elastomeric cord passes through an intermediate shell.

12. The protective helmet as recited in claim 1, wherein the outer shell is connected to the inner shell by at least one u-shaped elastomeric connector.

13. The protective helmet as recited in claim 1, wherein the at least one elastomeric cord is a helical spring.

14. The protective helmet as recited in claim 1, wherein said at least one expandable bladder is filled with gas.

15. The protective helmet as recited in claim 1, wherein said at least one expandable bladder is filled with liquid.

16. The protective helmet as recited in claim 1, further comprising one or more face protection device attachments.

17. The protective helmet as recited in claim 1, wherein the at least one expandable bladder is arranged in sliding contact with an outer surface of the inner shell.

18. A protective helmet, comprising:

an outer shell including at least one aperture;

an inner shell slidingly connected to the outer shell; and, at least one expandable bladder positioned between the outer shell and the inner shell, the at least one expandable bladder arranged in sliding contact with an outer surface of the inner shell;

wherein, when a force strikes the helmet, the at least one expandable bladder is operatively arranged to displace radially outward in the at least one aperture and protrude beyond an outer surface of the outer shell.

19. A protective helmet, comprising:

an outer shell including at least one aperture;

an elastomeric diaphragm connected to an inner surface of the outer shell and covering the at least one aperture;

an inner shell slidingly connected to the outer shell; and, at least one expandable bladder positioned between the outer shell and the inner shell, the at least one expandable bladder in sliding contact with an outer surface of the inner shell and operatively arranged to displace the elastomeric diaphragm in the at least one aperture of the outer shell.

* * * * *